US006061026A

United States Patent [19]

Ochi et al.

[11] Patent Number: 6,061,026

[45] Date of Patent: May 9, 2000

[54] MONOLITHIC ANTENNA

[75] Inventors: Masanori Ochi; Souichi Imamura, both of Yokohama; Shigehiro Hosoi, Kawasaki; Yutaka Ueno, Yokohama, all of Japan

[73] Assignee: Kabushiki Kaisha Toshiba, Kawasaki, Japan

[21] Appl. No.: 09/021,172

[22] Filed: Feb. 10, 1998

[30] Foreign Application Priority Data

Feb. 10, 1997 [JP] Japan ..... 9-026512

[51] Int. Cl.[7] ..... H01Q 1/38

[52] U.S. Cl. ..... 343/700 MS; 343/786; 343/795

[58] Field of Search ..... 343/700 MS, 795, 343/786, 770, 776, 772; H01Q 1/38

[56] References Cited

U.S. PATENT DOCUMENTS

| | | | |
|---|---|---|---|
| 4,527,165 | 7/1985 | De Ronde | 343/786 |
| 4,626,865 | 12/1986 | Rammos | 343/786 |
| 4,888,597 | 12/1989 | Rebiez et al. | 343/786 |

FOREIGN PATENT DOCUMENTS 7-74285 3/1995 Japan .

OTHER PUBLICATIONS

J.F. McIlvenna, Monolithic Phased Arrays for EHF Communications Terminals, Microwave Journal, Mar. 1988, pp. 113–125.

D.M. Pozar et al, Comparison of Architectures for Monolithic Phased Array Antennas, Microwave Journal, Mar. 1986, pp. 93–104.

R.J. Mailloux, Phased Array Architecture for mm–Wave Active Arrays, Microwave Journal, Jul. 1986, Nov. 14, 1997, pp. 117–124.

F.K. Schwering, Millimeter Wave Antennas, Proceedings of The IEEE, Jan. 1992, pp. 92–102.

*Primary Examiner*—Hoanganh Le
*Attorney, Agent, or Firm*—Oblon, Spivak, McClelland, Maier & Neustadt, P.C.

[57] ABSTRACT

A high-gain monolithic antenna with high freedom of design has a signal circuit and a stripline dipole antenna which are provided on a substrate. A dielectric film and a conductor cover covering the dielectric film are provided on the upper surface of the substrate, in addition to a hole extending vertically downward to the underside of the substrate, a conductor wall being provided on the surface thereof. Furthermore, a metallic film is evaporated so as to contact both a metallic cover and a conductor wall. A first grounding conductor and a dielectric are provided on the lower surface of the substrate, and a second grounding conductor is provided on the upper surface of the substrate. A horn, which is tapered into the dielectric and the first grounding conductor thereby forming the shape of a quadrangular pyramid, is provided so as to overlap a hole etched into the substrate. Microwaves or milliwaves are radiated to/from the horn to/from the underside of the substrate.

15 Claims, 5 Drawing Sheets

MONOLITHIC ANTENNA

BACKGROUND OF THE INVENTION

1. Field of the Invention

The present invention relates to a monolithic antenna, and more particularly to a monolithic microwave/milliwave antenna used in signal circuits, such as amplifiers, frequency converters, oscillators, transmitters and modulators, which have been combined in a single unit with an antenna for inputting and outputting microwave/milliwave band signals.

2. Description of the Related Arts

In general, antennas for inputting and outputting microwave/milliwave band signals have small dimensions, due to the shorter wavelength of the waves transmitted. Therefore, it is possible to construct a front end in which an antenna and a signal circuit, such as a transmit/receive circuit or the like, are combined in a single monolithic structure on, for instance, a semiconductor substrate such as gallium arsenide (GaAs). As a conventional example of such a configuration, a monolithic phased array antenna has been proposed. (For reference see for instance: J. F. Millvenna: "Monolithic Phased Arrays for EHF-Communications Terminals", Microwave Journal, pp.113–125, March 1988, D. M. Pozar et al: "Comparison of Architecture for Monolithic Phased Array Antennas", Microwave Journal, pp.93–104, March 1986, and R. J Mailloux: "Phased Array Architectures for mm-Wave Active Arrays", Microwave Journal, pp.117–120 July 1996).

In the conventional examples, in which this type of monolithic antenna is combined in a single unit with an RF circuit or an active element or the like, an antenna element and a feeding circuit are formed on a planar surface.

FIG. 9 is a perspective view of an example of a conventional monolithic microwave/milliwave dipole antenna.

As shown in the diagram, an active element circuit 13 and a stripline dipole antenna 12 are provided on the upper surface of a substrate14. In addition, a grounding conductor 15 is provided on another surface of the substrate 14.

In this configuration, the antenna resonates for electromagnetic waves having a wavelength equal to half the electrical length of the antenna and radiates the electromagnetic waves into space. In this case, the wavelength compression rate is $1/(\epsilon r)^{1/2}$. If we assume that $\epsilon r=12.7$ in the case when the substrate comprises GaAs, the compression rate will be 0.28. At 60 GHz, antenna length will be 0.7 mm.

Furthermore, FIG. 10 is a perspective view of an example of a conventional microwave/milliwave patch antenna.

Here, an active element circuit 13 and a stripline patch antenna 16 are disposed on the upper surface of a substrate 14 in a similar configuration to the example shown in FIG. 9. In addition, a grounding conductor 15 is provided on another surface of the substrate 14.

In this patch antenna, the distance from the input or output terminal to the opposite terminal is equivalent to half the wavelength of an electromagnetic wave. Since a certain amount of area is therefore required, the dipole antenna is superior from the point of view of area utilized. However, at 60 GHz, the half-wavelength of an electromagnetic wave in free space is 2.5 mm, which is greater than the 0.7 mm in the dipole example described above. As a consequence, the stripline antenna has the disadvantages that energy cannot be effectively radiated and therefore sufficient gain cannot be obtained. Furthermore, when the antenna is provided on a flat surface together with a feeding circuit, an active circuit or the like, the properties of the antenna are liable to deteriorate due to the protective resin for protecting the surface of the antenna when it is mounted in a package.

Furthermore, as a known example of an antenna similar to the above, FIGS. 11A and 11B show a perspective view and cross-sectional view of a conventional microwave/milliwave horn antenna array. (For reference, see for instance: Schwering: "Millimeter Wave Antennas", Proceedings of the IEEE, vol.80, No.1, January 1992)

This horn antenna array comprises antennas 20 provided in an array within a single plane. Each of the antennas 20 comprises an antenna element 21 and a pyramid-shaped horn 22. Furthermore, silicon wafers are separated into upper surface wafers 23 and underside wafers 24, with the antenna elements 21 sandwiched therebetween. The antenna elements 21 are held on the opening side by the vertexes of the pyramid horns 22.

However, in this configuration, the operation of etching in the semiconductor substrate in order to form the vertex side quadrangular pyramids is difficult. The above document refers to an example in which an Si <111> surface was used, but even when etching is performed on a wafer (100) surface of GaAs used as an MMIC (Monolithic Microwave Integrated Circuit) substrate, it is not possible to achieve a precise pyramid shape. An improved etching method is therefore needed to achieve this configuration.

Furthermore, FIG. 12 shows a configuration of a conventional single-unit antenna semiconductor device (for instance, as disclosed in Japanese Patent Application Laid-Open No. 7-74285 (1995)).

In this conventional example, a pellet 31, which has a circuit portion 31*a*, including such as a transistor, and a patch antenna 3*b*, is positioned facedown above a conductor 35 on a silicon substrate 32 and is connected thereto by bumps 33. The substrate 32 has a tapered horn to which a conductor 36 is provided. In addition, a conductor 34 for reflecting waves is provided to the underside of the pellet 31.

However, since this configuration is not monolithic, the overall dimensions are increased by an amount equal to the portion which cannot be provided monolithically. Moreover, a size of its package is increased with a consequent increase in cost-efficiency. Furthermore, since the semiconductor chip (pellet 31) must be manufactured separately from the antenna portion (substrate 32), this configuration is not cost efficient to assemble.

SUMMARY OF THE INVENTION

Accordingly, it is a primary object of the present invention to provide a monolithic antenna in which an antenna and a signal circuit can be designed independently from each other without providing an antenna element on a signal circuit board, such as an RF circuit or a feeding circuit, thereby increasing the level of freedom in designing.

It is another object of the present invention to provide a monolithic antenna which can be manufactured by simplified manufacturing process in which no mounting of semiconductor chip by means of bumps and the like is required.

It is further object of the present invention to provide a high-gain monolithic microwave/milliwave antenna having a reduced chip area.

In order to achieve the above objects, the present invention provides a monolithic antenna comprising:

- a substrate having an opening;
- a stripline antenna which is provided over said opening of said substrate;
- a signal circuit for inputting and outputting signals from/to said stripline antenna, said signal circuit being provided on said substrate;

a conductor wall which is provided on a surface of said opening in said substrate;

a conductor cover which is connected to said conductor wall, said conductor cover being provided so as to cover said stripline antenna;

a first grounding conductor which is connected to said conductor wall, said first grounding conductor being provided to said substrate on an opposite side to said stripline antenna and said signal circuit;

a dielectric which is provided on a side of said first grounding conductor which is opposite to said substrate, said dielectric having an open horn portion which is joined to said opening of said substrate; and a second grounding conductor which is connected to said first grounding conductor, said second grounding conductor covering a surface of said dielectric which includes said horn portion.

According to the second aspect of the present invention, there is provided a monolithic antenna comprising:

a substrate having a opening;

a stripline antenna which is provided over said opening of said substrate;

a signal circuit for inputting and outputting signals from/to said stripline antenna, said signal circuit being provided on said substrate;

a conductor wall which is provided to a surface of said opening in said substrate;

a conductor cover which is connected to said conductor wall, said conductor cover being provided so as to cover said stripline antenna;

a first grounding conductor which is connected to said conductor wall, said first grounding conductor being provided to said substrate on an opposite side to said stripline antenna and said signal circuit; and a metallic body which is provided on a side of said first grounding conductor which is opposite to said substrate, said dielectric having an open horn which is joined to said opening of said substrate.

In this structure, a second dielectric, said dielectric may be provided entirely throughout said conductor cover or to a portion on said stripline antenna.

According to the present invention, an antenna can be designed independently from designing signal circuits without providing an antenna element on a signal circuit board such as an RF circuit or a feeding circuit, consequently increasing the level of freedom in designing.

Furthermore, since the monolithic antenna of the present invention does not require the application of a semiconductor chip and the like by means of bumps and the like, the manufacturing process is simplified.

Still further, chip area can be reduced and a high-gain monolithic microwave/milliwave antenna can be provided.

DETAILED DESCRIPTION OF THE INVENTION

Figure 1:
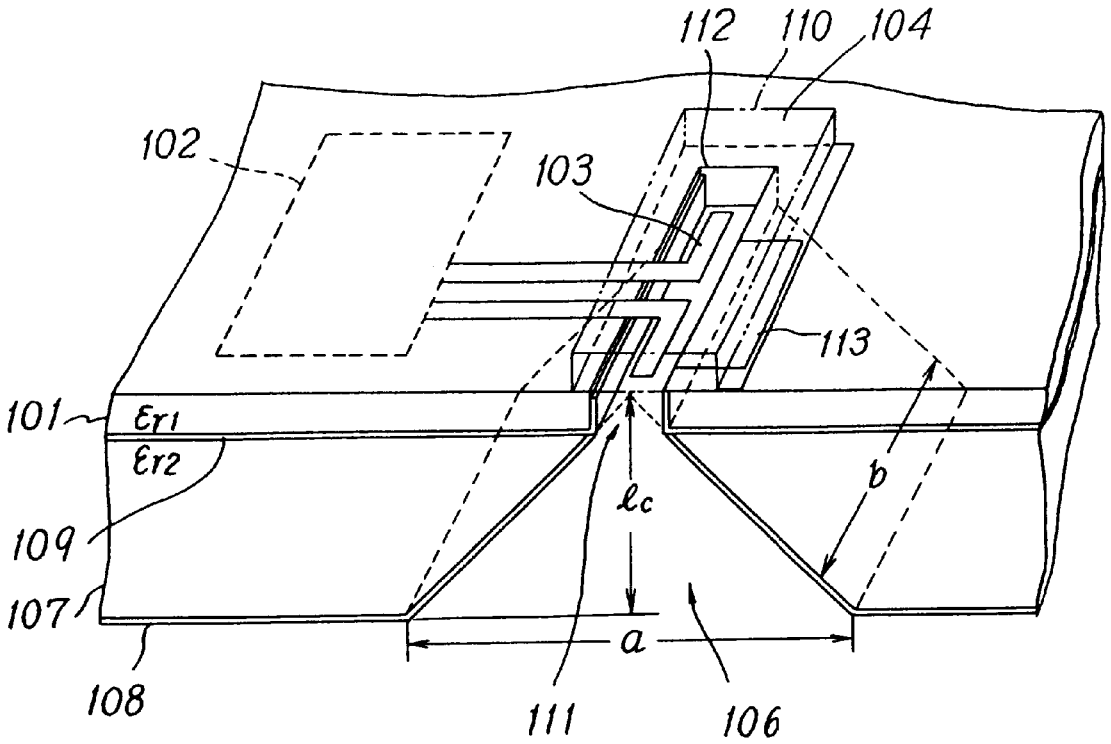
FIG. 1 is a perspective view of a monolithic microwave/milliwave antenna in a first embodiment of the present invention.

The preferred embodiments of the monolithic antenna of the present invention will next be explained with reference to the attached drawings. FIG. 1 is a perspective view of a monolithic microwave/milliwave antenna according to a first embodiment of the present invention.

As FIG. 1 shows, a signal circuit 102 comprising an active element circuit or the like, such as a feeding circuit, is provided in a stripline or the like on a GaAs substrate 101, for instance. Furthermore, a stripline dipole antenna 103, having a half-wave dipole antenna bending at right angles, connects from the output terminal of the signal circuit 102 on the substrate 101.

A dielectric film 104, such as SiN film or $SrTiO_3$ or the like, is provided over the stripline dipole antenna 103. The thickness of this dielectric film 104 is set to a half-wavelength, as required by the dielectric constant of the dielectric film 104. Moreover, a conductor cover 110, which has a metallic film formed by sputtering of Ti/Au or the like for instance, is provided so as to cover the dielectric film 104. However, a slit is provided to ensure that this metallic film does not contact with the upper portion of the output terminal. The conductor cover 110 has an opening into which the half-wavelength stripline dipole antenna 103 fits exactly. The length and width of the opening along the length and width of the dipole portion are at least twice the wavelength of waves transmitted/received from the input and output terminals. Furthermore, a hole 111 running downwards to the underside of the substrate 101 is provided by etching, and a conductor wall 112 is provided on the inner surface of the hole 111 by evaporating a metallic film, for instance Ge/Au or the like, from the underside. A metallic film 113, comprising for instance Ti/Pt/Au, is provided on the substrate 101 on the side opposite to the opening for the stripline so as to contact the conductor cover 110 which covers the dielectric film 104 and the conductor wall 112.

Furthermore, a first grounding conductor 109 is provided on the underside of the substrate 101 as a grounding electrode. A dielectric 107 comprising a resin film having a thickness of several millimeters is affixed to the underside of the substrate 101. A metallic conductor such as, for instance, Ge/Au is evaporated onto the surface of the underside of the substrate 101, thereby forming a second grounding conductor 108. The second grounding conductor 108 is tapered in the shape of a pyramid, so as to form a horn 106 corresponding to the hole 111 etched into the substrate 101. Anisotropic dry etching is used to achieve this pyramid-shaped tapering. Microwaves or milliwaves are radiated from the horn 106 to the underside of the substrate 101, and from the substrate 101 to the horn 106.

Figure 2:
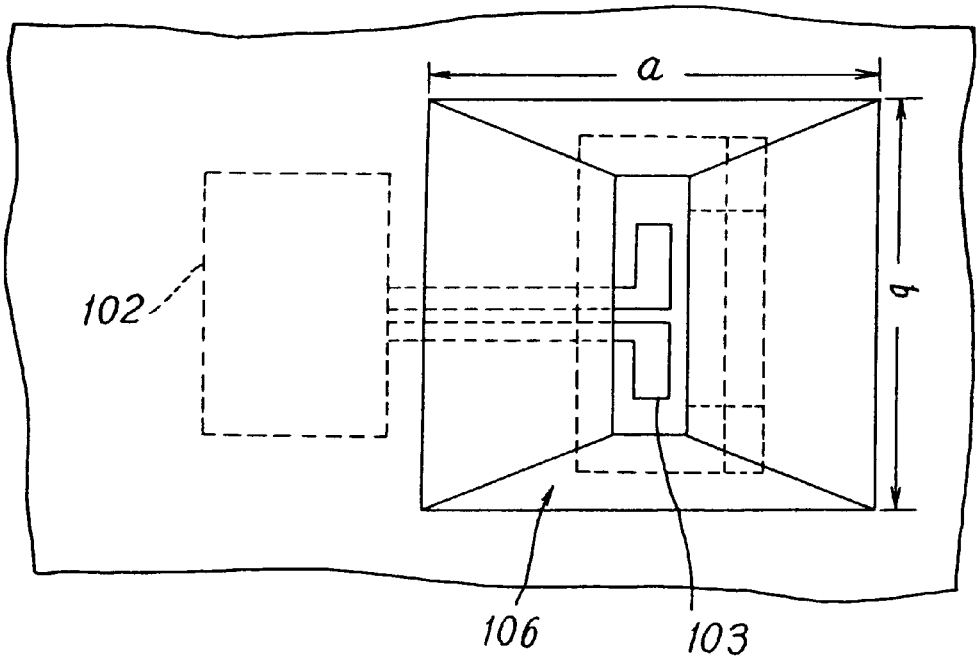
FIG. 2 is an underside view of a monolithic microwave/milliwave antenna in a first embodiment of the present invention.

FIG. 2 shows an underside view of a monolithic microwave/milliwave antenna according to the first embodiment of the present invention.

When the horn 106 has the shape shown in FIG. 2, reducing the area of the underside has no effect on the area of the upper surface since gain is directly proportional to the area ab of the opening through which microwaves and milliwaves are emitted, and chip area is not increased as a result. Furthermore, this chip can be mounted directly onto the package as a flip-chip. Even when a protective resin is provided between the package and the surface of the chip prior to mounting, this has no effect on the antenna opening on the underside and therefore there is no need for concern about damage to the properties of the antenna.

In the present example, SiN film was selected as the dielectric film 104 on the stripline dipole antenna 103, but a strongly dielectric film having high dielectric constant may alternatively be used in order to reduce the thickness of the film as much as possible. For instance, film thickness can be further reduced by selecting $SrTiO_3$ or $BaTiO_3$ or the like as the dielectric film 104. This increases the gain of the antenna and improves antenna orientation.

Figure 3:
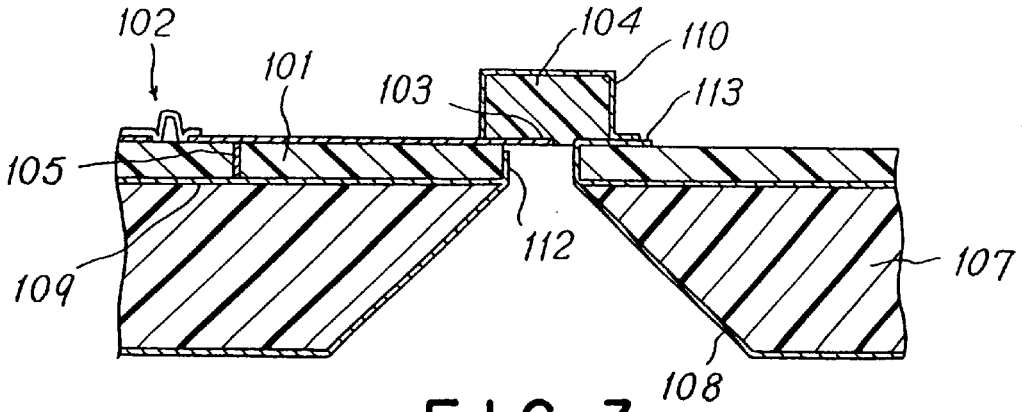
FIG. 3 is a cross-sectional view of a monolithic microwave/milliwave antenna in a first embodiment of the present invention.

Further, FIG. 3 is a cross-sectional view of a monolithic microwave/milliwave antenna in the first embodiment of the present invention. As FIG. 3 shows, the stripline dipole antenna 103 is supported by means of adhesion between the upper portion of the stripline dipole antenna 103 and the dielectric film 104 comprising SiN film or $SrTiO_3$ film. The stripline dipole antenna 103 and the conductor wall 112 are electrically separated. This is achieved by providing, for instance, a gap or insulating film therebetween.

Furthermore, the signal circuit 102 and the first grounding conductor 109 can be connected as required by providing a conductive contact hole 105 in the substrate 101.

Figure 4:
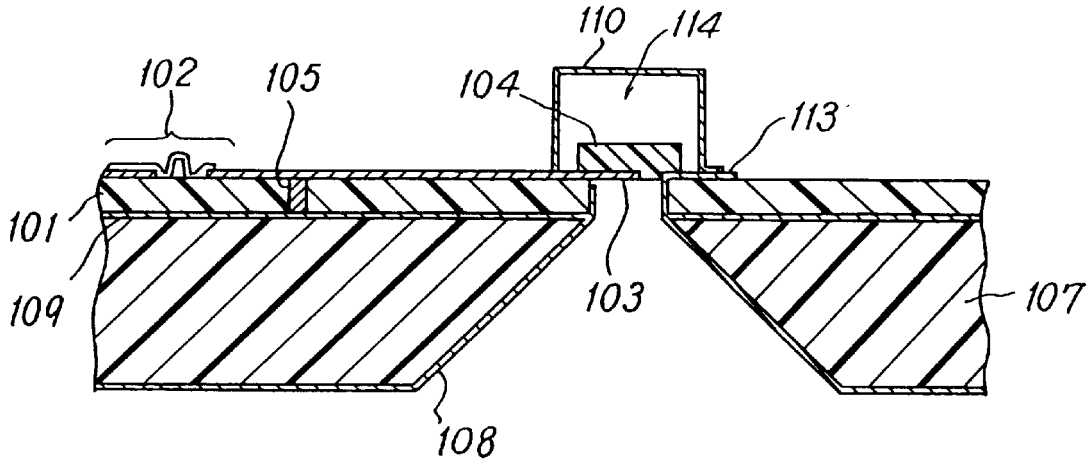
FIG. 4 is a cross-sectional view of a monolithic microwave/milliwave antenna in a second embodiment of the present invention.

Next, FIG. 4 is a cross-sectional view of a monolithic microwave/milliwave antenna according to a second embodiment of the present invention.

As FIG. 4 shows, the present embodiment differs from the first embodiment in that one portion of the dielectric film 104, comprising SiN film or such like, which is provided above the stripline dipole antenna 103 has a void 114. The conductor cover 110, which comprises a metallic film, is provided like an air bridge over the void 114 so as to cover the hole 111 and the stripline dipole antenna 103.

The portion which is covered on the outside by the conductor cover 110 corresponds in effect to a waveguide, through which excited electromagnetic waves are emitted to the underside. Furthermore, a dielectric film known as BCB (benzocyclobutene) can be used instead of SiN for the dielectric film 104.

Moreover, the dielectric film 104 can be dispensed with entirely so that the inner portion of the conductor cover 110 houses only the void 114.

Figure 5:
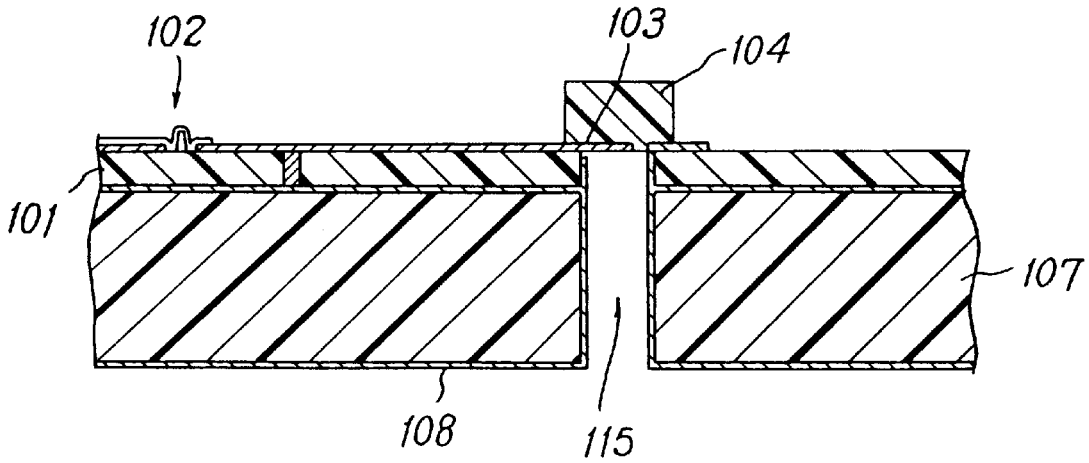
FIG. 5 is a cross-sectional view of a monolithic microwave/milliwave antenna in a third embodiment of the present invention.

Next, FIG. 5 is a cross-sectional view of a monolithic microwave/milliwave antenna in a third embodiment of the present invention. As FIG. 5 shows, in the third embodiment, the horn 106 comprises a waveguide hole 115 which is provided in the resin film of the dielectric 107. The waveguide hole 115 is rectangular when viewed in cross-section and is perpendicular to the underside so as to function as a waveguide tube, and can be connected to the underside with no change in the impedance of the waveguide.

According to this configuration, it is possible to freely select an antenna to be connected to the waveguide. Additional advantages of this configuration are that loss can be reduced, and electromagnetic waves can be transmitted and received in all directions.

Figure 6:
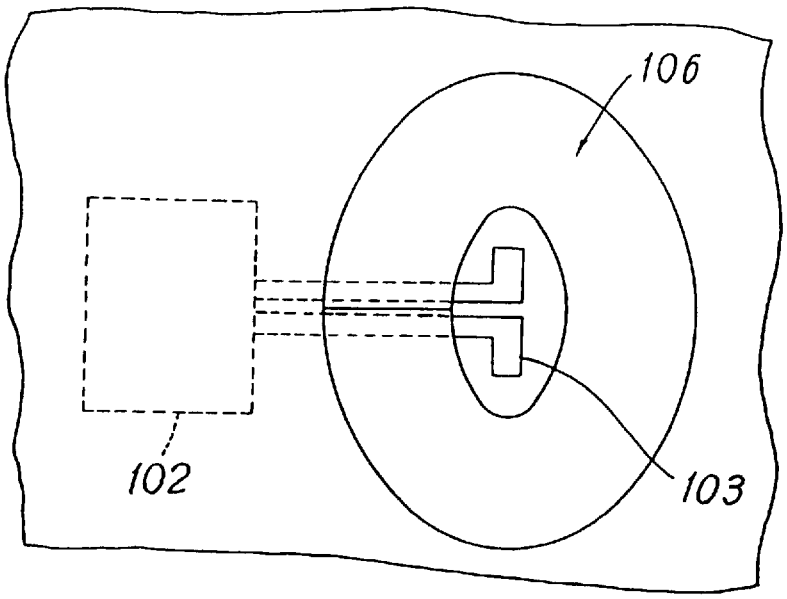
FIG. 6 is an underside view of a monolithic microwave/milliwave antenna in a fourth embodiment of the present invention.

Next, FIG. 6 is an underside view of a monolithic microwave/milliwave antenna according to a fourth embodiment of the present invention.

As FIG. 6 shows, in this embodiment, the tapered horn 106 is oval when viewed from underside. Consequently, even in the case when the dielectric 107 has a crystal structure such as a GaAs substrate, etching can be easily performed without needing to consider the crystal orientation, thereby contributing to a reduction in cost of manufacturing process.

Figure 7:
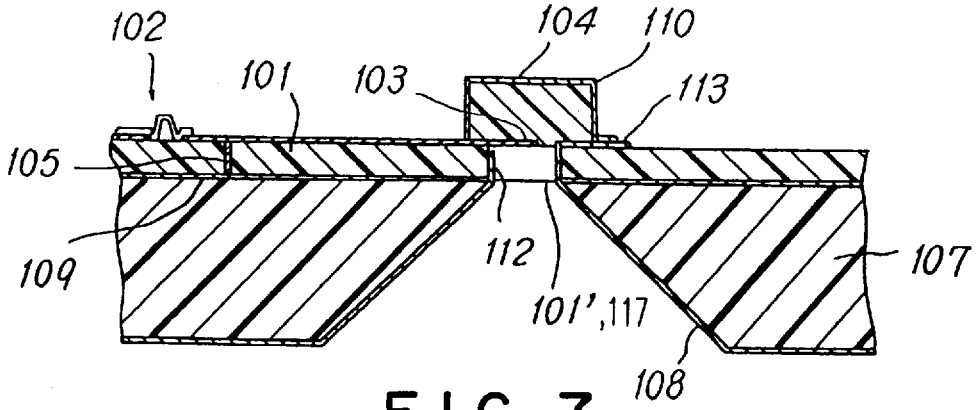
FIG. 7 is a cross-sectional view of a monolithic microwave/milliwave antenna in a fifth embodiment of the present invention.

FIG. 7 is a cross-sectional view of a monolithic microwave/milliwave antenna according to a fifth embodiment of the present invention.

As FIG. 7 shows, the hole 111 featured in the first embodiment is not provided in the fifth embodiment, and the suspension 101' consequently remains intact. Alternatively, the substrate 101' can acceptably be filled with material 117 such as another type of dielectric. With this configuration, the stripline dipole antenna 103 is supported above by the dielectric film 104 (for instance, $SrTiO_3$) and below by the substrate 101' which comprises a dielectric (for instance, a GaAs substrate). In other words, the stripline dipole antenna 103 is sandwiched between supporting dielectrics.

In this case, as above, electromagnetic waves can be transmitted and received to and from the underside through the substrate 101' comprising GaAs or the like. In addition, by optimizing the angle at which the dielectric 107 is tapered, signal strength can be maximized and electromagnetic waves can be concentrated in the dipole portion.

Figure 8:
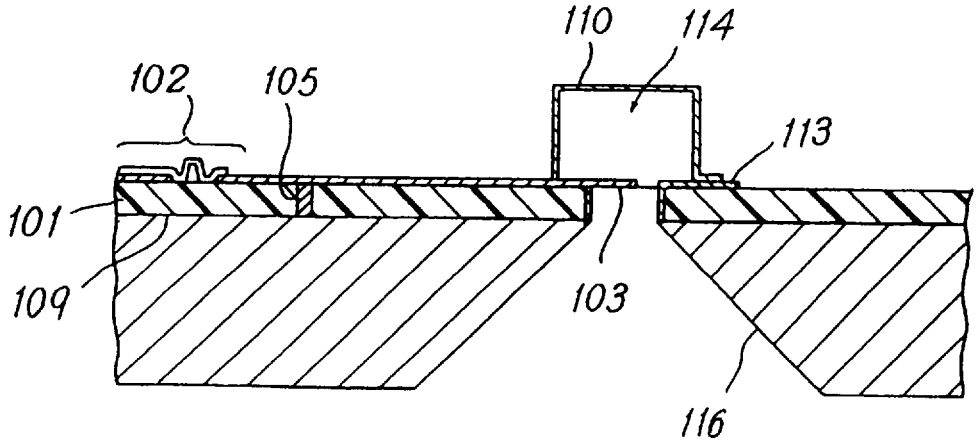
FIG. 8 is a cross-sectional view of a monolithic microwave/milliwave antenna in a sixth embodiment of the present invention.
Figure 9:
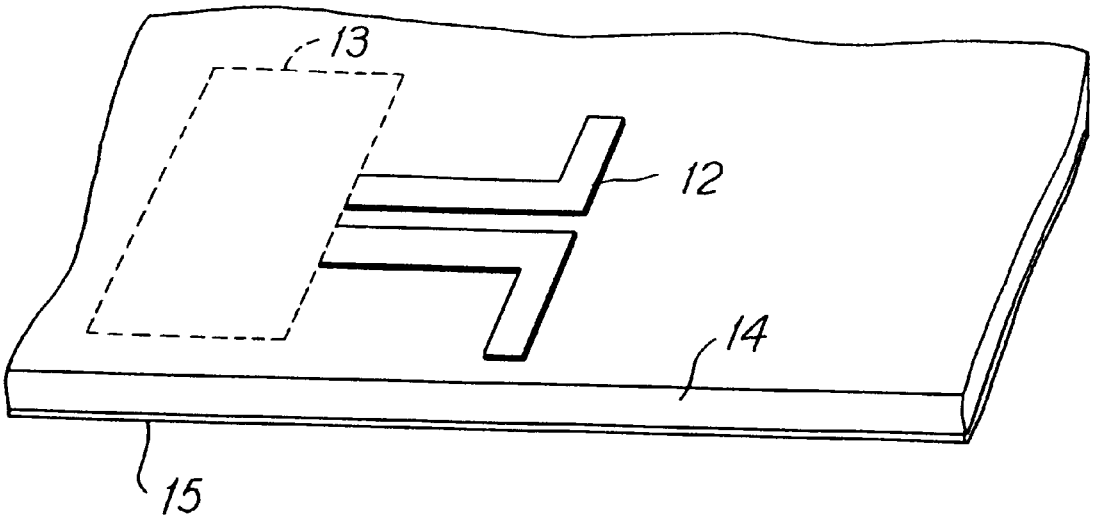
FIG. 9 PRIOR ART
FIG. 9 is a perspective view of a conventional monolithic microwave/milliwave dipole antenna.
Figure 10:
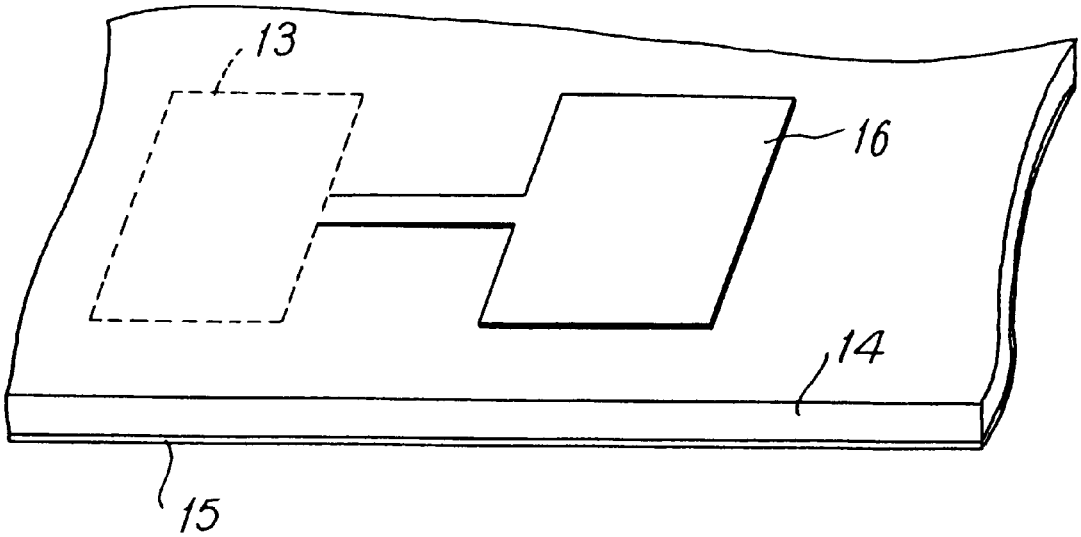
FIG. 10 PRIOR ART
FIG. 10 is a perspective view of a conventional monolithic microwave/milliwave patch antenna.

Next, FIG. 8 is a cross-sectional view of a monolithic microwave/milliwave antenna according to a sixth embodiment of the present invention.

As FIG. 8 shows, the sixth embodiment differs from the first embodiment in that the dielectric 107 and the second grounding conductor 108 have been entirely replaced by a metallic body 116. The horn 106 is provided as in the embodiments described above, but in the present embodiment there is no need to consider the crystal orientation, as was necessary in the case where dielectrics were used.

In the case depicted in FIG. 8, no dielectric film 104 is provided within the conductor cover 110, leaving only the void 114.

As explained above, the horn 106 and the hole 111 can be provided in predetermined shapes as required. Furthermore, the internal configuration of the conductor cover 110 can be selected as appropriate, and can be assembled with an appropriately shaped horn 106 and hole 111.

Figure 11A:
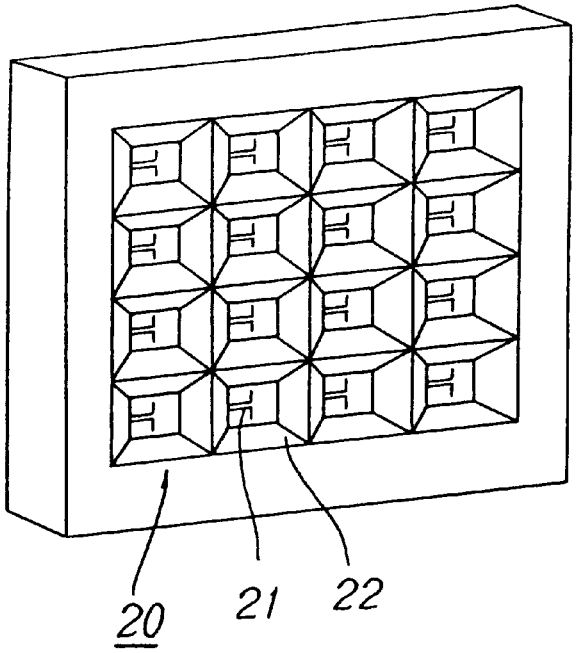
PRIOR ART FIG. 11A
FIG. 11A is a perspective view of a conventional monolithic microwave/milliwave antenna array.
Figure 11B:
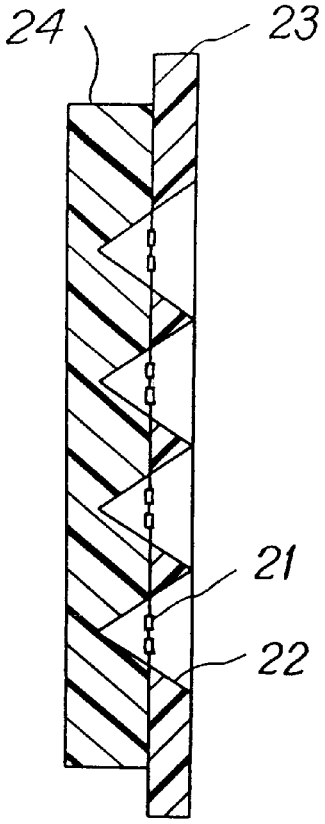
PRIOR ART FIG. 11B
FIG. 11B is a cross-sectional view of a conventional monolithic microwave/milliwave antenna array.
Figure 12:
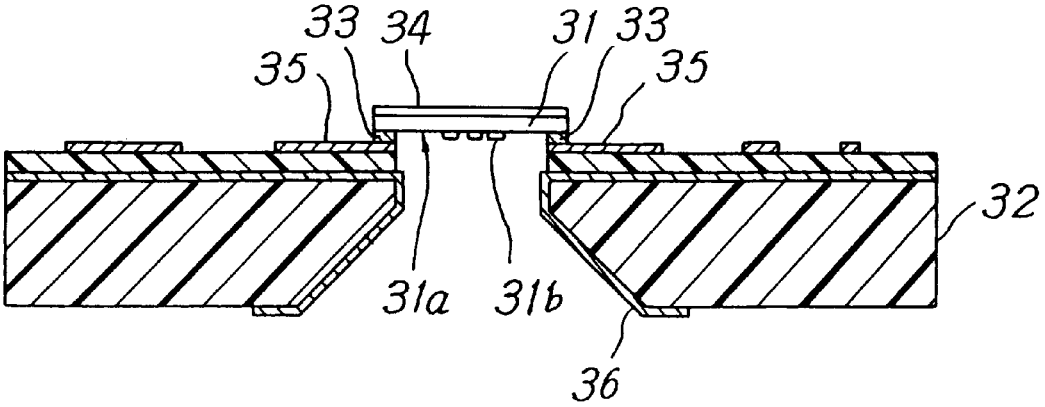
FIG. 12 PRIOR ART
FIG. 12 is a cross-sectional view of a conventional single-unit antenna MMIC.

Furthermore, a dipole antenna array can be formed in matrix form as shown in FIG. 11A by providing multiple dipole antennas having the above configuration in rows and columns. In this case, a single signal circuit 102 can be provided for all the stripline dipole antennas 103, or a signal circuit 102 can be provided to each stripline dipole antenna 103, or to a block of stripline dipole antennas 103.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A monolithic antenna comprising:

a substrate having an opening;

a stripline antenna element which is provided over said opening of said substrate;

a signal circuit provided on said substrate and configured to input and output signals from and to said stripline antenna element;

a conductor wall which is provided on a surface of said opening in said substrate;

a conductor cover connected to said conductor wall and configured to cover said stripline antenna element;

a first grounding conductor connected to said conductor wall and provided on a side of said substrate opposite said stripline antenna and said signal circuit;

a second grounding conductor connected to said first grounding conductor, a horn member having an open horn portion joined to said opening of said substrate on a side of said first grounding conductor, wherein said open horn portion is provided in a first dielectric member and the second grounding conductor covers a surface of said first dielectric member.

2. A monolithic antenna according to claim 1, wherein material of said substrate remains unaltered in said opening of said substrate.

3. A monolithic antenna according to claim 1, wherein said opening of said substrate is filled with a dielectric material.

4. A monolithic antenna according to claim 1, wherein said open horn portion opens so that the area thereof becomes larger than the area of the opening as the distance between said open horn portion and said opening increases.

5. A monolithic antenna according to claim 1, wherein said opening and a horizontal cross-section of said horn member are rectangular shapes, said open horn portion forms a quadrangular pyramid, and the distance from the vertex of said quadrangular pyramid to an opening surface of said first dielectric member is less than the sum of the thickness of said substrate and the thickness of said first dielectric member.

6. A monolithic antenna according to claim 1, wherein said open horn portion has approximately the same opening shape and/or opening area as the area of said opening.

7. A monolithic antenna according to claim 1, wherein said open horn portion is provided in a metallic body which is provided on a side of said first grounding conductor which is opposite to said substrate.

8. A monolithic antenna according to claim 7, further comprising:

a second dielectric member, said second dielectric member being provided entirely throughout said conductor cover or to a portion on said stripline antenna element.

9. A monolithic antenna according to claim 8, wherein said substrate further comprises a third dielectric member which supports said stripline antenna element.

10. A monolithic antenna according to claim 7, further comprising:

a contact hole for connecting said signal circuit to said first grounding conductor, said contact hole being provided in said substrate.

11. A monolithic antenna according to claim 7, wherein said horn member has an oval-shaped opening surface having a cross-sectional tapered hole from a hole of at least one of said first dielectric member and said metallic body provided therein.

12. A monolithic antenna according to claim 7, wherein said opening and horizontal cross section of said horn member are rectangular shapes, said open horn portion forms a quadrangular pyramid, and the distance from the vertex of said quadrangular pyramid to an opening surface of said metallic body is less than the sum of the thickness of said substrate and the thickness of said metallic body.

13. A monolithic antenna according to claim 7, wherein said open horn portion has approximately the same opening shape and/or opening area as the area of said opening.

14. A monolithic antenna according to claim 1, wherein said open horn portion is produced by a process comprising a step of an anisotropic etching.

15. A monolithic antenna according to claim 1, wherein a plurality of said stripline antenna elements are arranged in matrix form.

* * * * *